US006790000B2

(12) United States Patent
Wolf

(10) Patent No.: US 6,790,000 B2
(45) Date of Patent: Sep. 14, 2004

(54) SHROUD FOR THE ROOTS OF VARIABLE STATOR VANES IN THE HIGH-PRESSURE COMPRESSOR OF A GAS TURBINE

(75) Inventor: Norbert Wolf, Loehnberg (DE)

(73) Assignee: Rolls-Royce Deutschland Ltd & Co KG, Dahlewitz (DE)

( * ) Notice: Subject to any disclaimer, the term of this patent is extended or adjusted under 35 U.S.C. 154(b) by 79 days.

(21) Appl. No.: 10/316,845

(22) Filed: Dec. 12, 2002

(65) Prior Publication Data

US 2003/0113204 A1 Jun. 19, 2003

(30) Foreign Application Priority Data

Dec. 13, 2001 (DE) ..... 101 61 292

(51) Int. Cl.[7] ..... F01B 25/02
(52) U.S. Cl. ..... 415/165; 415/209.2
(58) Field of Search ..... 415/165, 209.2–4, 415/160–164, 210.1, 189, 146–148

(56) References Cited

U.S. PATENT DOCUMENTS 2,868,439 A * 1/1959 Hampshire et al. ..... 415/141
3,824,034 A 7/1974 Leicht
4,514,141 A 4/1985 Marey
4,706,354 A 11/1987 Naudet et al.
4,792,277 A 12/1988 Dittberner, Jr. et al.
4,834,613 A 5/1989 Hansen et al.
5,062,767 A 11/1991 Worley et al.
5,279,031 A * 1/1994 Carruthers et al. ..... 29/889.2
5,328,327 A 7/1994 Naudet
5,421,703 A 6/1995 Payling
5,636,968 A 6/1997 Audet et al.
6,086,327 A 7/2000 Mack et al.
6,129,512 A 10/2000 Agram et al.
6,164,903 A * 12/2000 Kouris ..... 415/135
6,261,058 B1 * 7/2001 Kataoka et al. ..... 415/189

FOREIGN PATENT DOCUMENTS

DE 19518203 12/1995

* cited by examiner

*Primary Examiner*—Edward K. Look
*Assistant Examiner*—James M. McAleenan
(74) *Attorney, Agent, or Firm*—Harbin King & Klima

(57) ABSTRACT

A shroud for the support of vane roots 1 of variable stator vanes 2 in the high-pressure compressor of a gas turbine includes a forward shroud segment 3 and a rearward shroud segment 4, each with an axially open annulus 5 forming an essentially U-shaped cross-section and with a plurality of axial assembly holes 6, wherein an annular cover 7 is arranged in the area of the opening of the annulus 5 which is provided with assembly openings 8 and tubular supports 9 are provided in the area between the assembly openings 8 of the cover 7 and the associated assembly hole 5 of the shroud segments 3, 4.

20 Claims, 4 Drawing Sheets

SHROUD FOR THE ROOTS OF VARIABLE STATOR VANES IN THE HIGH-PRESSURE COMPRESSOR OF A GAS TURBINE

This application claims priority to German Patent Application DE10161292.3, filed Dec. 13, 2001, the entirety of which is incorporated by reference herein.

BACKGROUND OF THE INVENTION

This invention relates to a shroud for the support of roots of variable stator vanes in the high-pressure compressor of a gas turbine.

More particularly, the present invention relates to a shroud as it is used for the inner support of variable stator vanes primarily in the area of the high-pressure compressors of present-day turbofan engines.

Such shrouds are usually made of aluminium, steel alloy or titanium. A design of this type is exemplified in U.S. Pat. No. 5,062,767.

The shrouds normally consist of two parts so that there is a front and a rear shroud segment. These shroud segments are annular. For weight reduction, an axial annulus is provided in these shroud segments which is produced by turning machining, for example. In order to reduce air swirls, vibrations and noise generation, the annulus is provided with a rubber filling in the state of the art. This filling is applied by way of vulcanization.

Such rubber fillings are disadvantageous in several respects. One disadvantage is the high effort required for production involving a manual special process which is time-consuming and, therefore, expensive. This special process normally comprises several operations, in particular cleaning, priming, filling, heat-treatment and removal of surplus rubber material as well as subsequent re-cleaning of the segments of the shroud. Quality problems may arise from lack of adhesion or from bubbling of the rubber material. In operation, the rubber filling is susceptible to failure since it is subject to ageing and tends to develop cracks at the joints. Furthermore, the rubber filling has a relatively high weight.

BRIEF SUMMARY OF THE INVENTION

In a broad aspect, the present invention provides a shroud of the type specified at the beginning which, while avoiding the disadvantages of the state of the art, features simplicity of design, easy and cost-effective production and, in particular, light weight.

It is a particular object of the present invention to provide a solution to said problems by a combination of the features described herein, with further objects and advantages of the present invention becoming apparent from the description below.

The present invention, therefore, provides for an annular cover arranged in the area of the opening of the annulus, this annular cover being provided with assembly openings. In addition, provision is made for a tubular support arranged in the spacing between the assembly recess of the cover and the corresponding assembly hole of the shroud segment.

The shroud according to the present invention features a variety of merits.

In accordance with the present invention, the rubber filling, which features the above-mentioned disadvantages, is replaced by an annular cover. Compared with a rubber-filled shroud segment, the shroud segment thus provided features a very similar or identical outer contour.

Accordingly, the acoustic properties and the flow conditions, which may give rise to air swirls and vibrations, develop very favourably and at least achieve the values known from state-of-the-art shrouds.

A major advantage of the solution according to the present invention is the simple and rapid manner in which it can be produced. The expensive operations required for the application of the rubber filling can now completely be dispensed with. This results in a clear cost advantage over the state of the art.

Another major advantage lies in the fact that no materials that are susceptible to ageing, such as rubber, are applied. This provides for increased reliability and life.

Still another advantage is the weight reduction obtained owing to the absence of a filling with rubber or any other filling material.

Changes to the design of the shroud segments are not required since the cover according to the present invention is fitted into the area of the mouth of the annulus. This enables existing shroud segments to be converted accordingly upon removal of the rubber filling.

It is also advantageous that the cover can be removed and re-installed at any time, for example for maintenance or other work.

In a particularly favourable form of the present invention, the cover is designed essentially as a flat ring. This ring may simply be made of sheet metal, for example aluminium or titanium. It is also particularly favourable to profile the cover at least at its rims. Such edging or flanging may give a particularly favourable clamping effect or an interference fit, thus ensuring the operational safety of the cover fitted into the annulus.

In order to avoid vibrations and similar occurrences, additional stiffening measures may be applied, such as beading or the like.

The support is preferably cup-shaped or hat-shaped. Like the cover, it can be made of sheet metal by rolling or deep-drawing or a similar shaping process. It is also particularly favourable if the free rim area of the support is profiled for retention of the cover, for example by bending or flanging. Thus, the support locates the cover and restrains it against the shroud segment, ensuring safe attachment. Restraint is applied via the fixing bolts which are also used for clamping the two shroud segments of the shroud. The supports are preferably dimensioned such that they are slightly shorter than the depth of the annulus of the shroud segments. This clearance may be 0.5 mm, for example. Accordingly, restraint is applied to the cover by way of the bolted connection.

The covers and the supports may be one-part or multi-part. The covers and/or supports may also be made of a plastic or similar material, for example by injection moulding, instead of a metallic material as described above.

BRIEF DESCRIPTION OF THE DRAWINGS

This invention is more fully described in the light of the accompanying drawings showing a preferred embodiment. On the drawings.

DETAILED DESCRIPTION OF THE INVENTION

Figure 1:
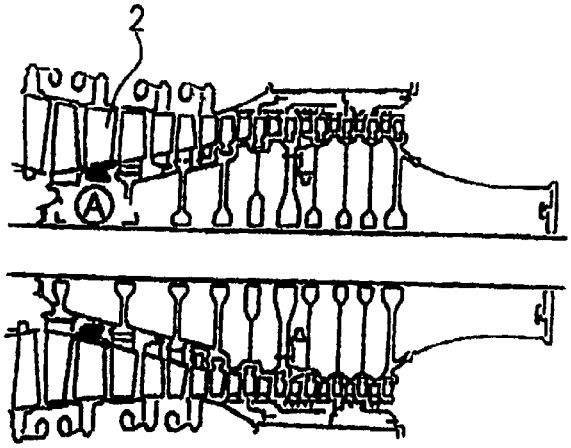
FIG. 1 is a schematic view of a partial area of a gas turbine.

FIG. 1 shows in highly simplified form a partial area of a gas turbine according to the state of the art. Area A indicates the position of a shroud for the support of the stator vanes 2. A more detailed description of the schematically shown components is dispensed with herein since they are known from the state of the art.

Figure 2:
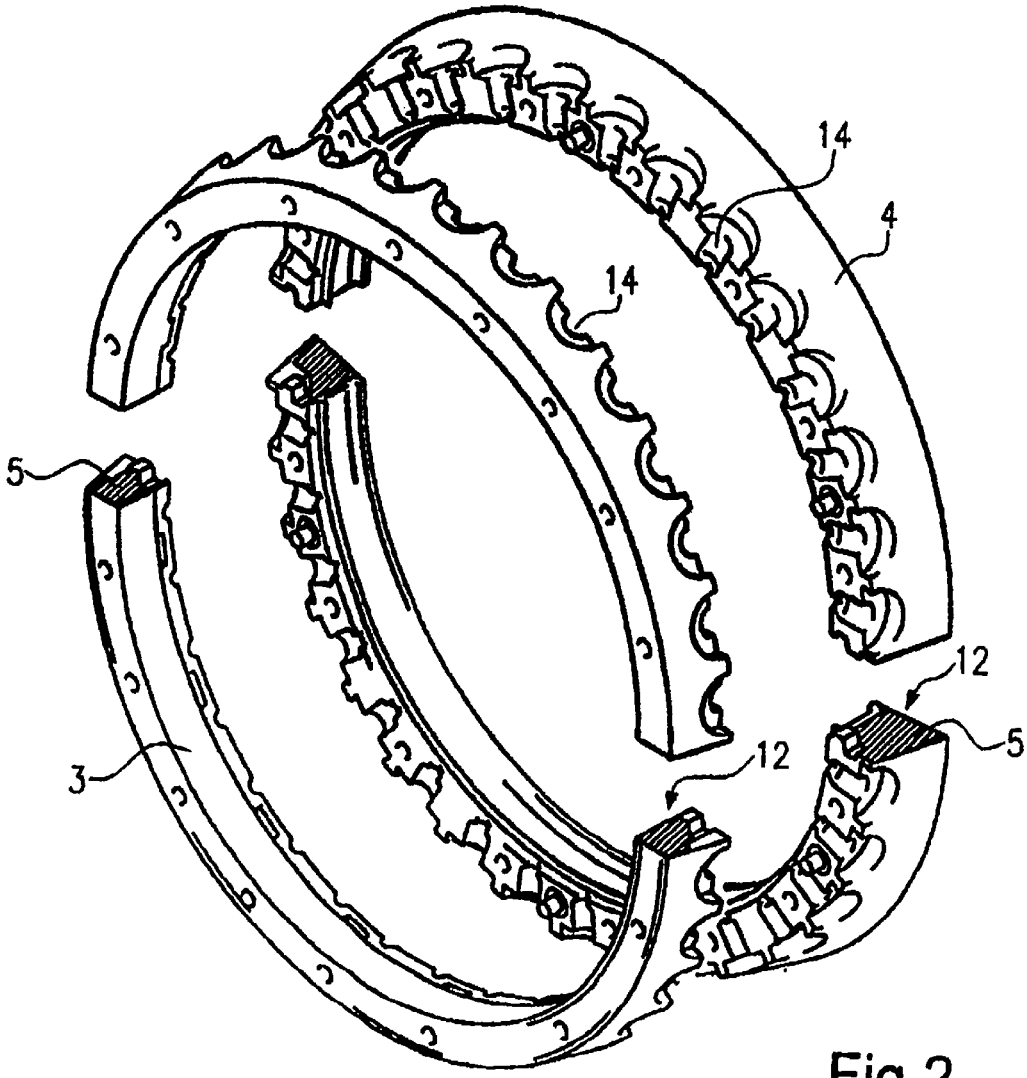
FIG. 2 is a perspective view of a two-part shroud according to the state of the art.
Figure 3:
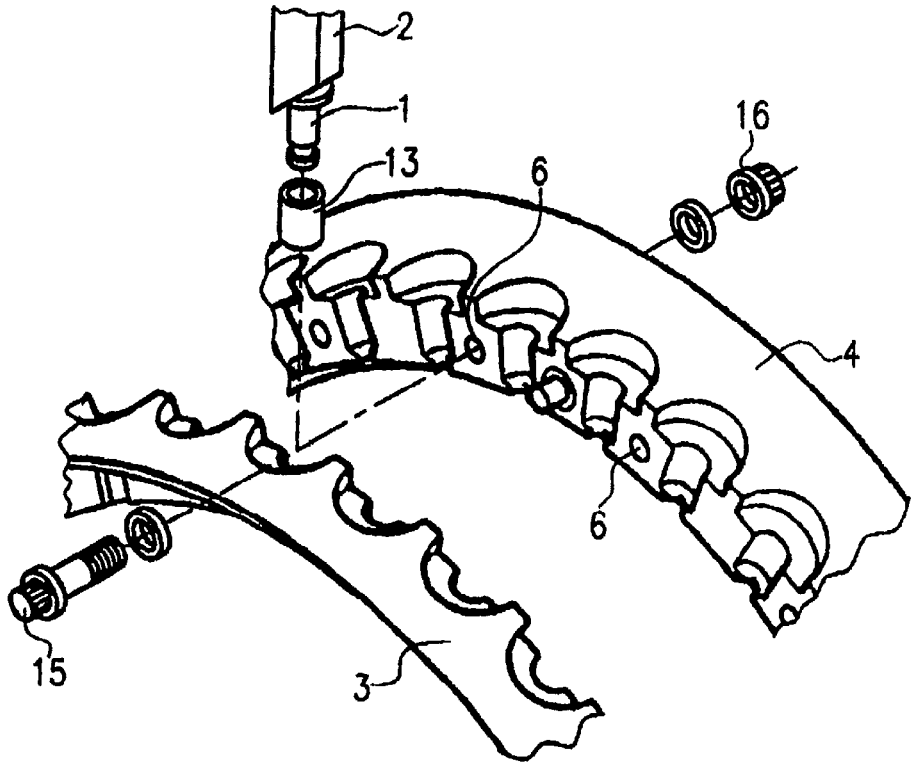
FIG. 3 is an enlarged partial view analogically to FIG. 2 of a shroud according to the state of the art.

FIG. 2 shows in perspective exploded view a state-of-the-art shroud consisting of a forward shroud segment 3 and a rearward shroud segment 4. The two shroud segments 3, 4 are each turning-machined at their faces and the annulus 5 thus produced is provided with a rubber filling 12. Equally shared between the shroud segments 3, 4 are recesses 14 which (see FIG. 3) bear bushes 13 for the support of the vane roots 1 of the respective stator vanes 2. The stator vanes 2 are rotatable in the known manner to enable their angle of incidence to be varied. This allows the performance of the compressor to be adjusted to the operating conditions.

The two shroud segments 3, 4 are bolted together by a plurality of bolts 15 and nuts 16. For this purpose, corresponding assembly holes 6 are provided in the shroud segments 3, 4.

Figure 4:
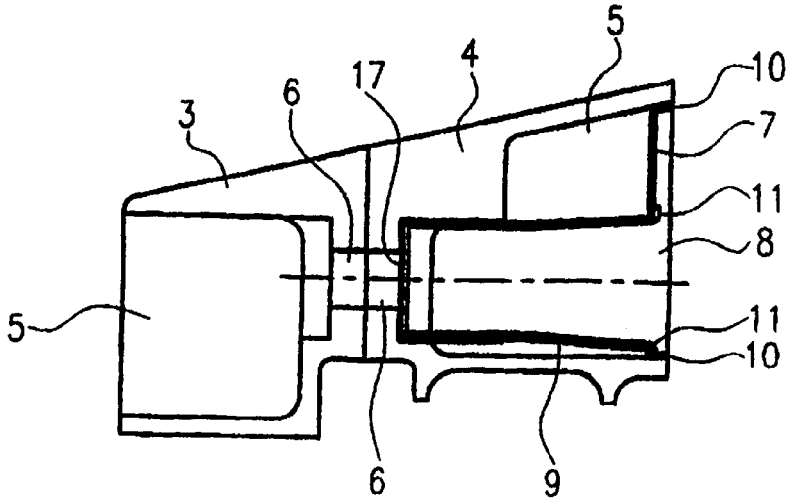
FIG. 4 is a partial sectional view of an embodiment of the shroud according to the present invention.

FIG. 4 shows in simplified sectional view the design of the shroud according to the present invention. As already described, the shroud comprises a forward shroud segment 3 and a rearward shroud segment 4. Both shroud segments are provided with the above-mentioned assembly holes 6. FIG. 4 further shows the two annuli 5, each essentially U-shaped and open in the axial direction.

FIG. 4 shows a cover having an essentially flat, annular body 7 (also refer to FIGS. 5 and 6) with a corresponding number of assembly openings 8 arranged in alignment with the assembly holes 6 to allow installation of the bolts 15.

Figure 7:
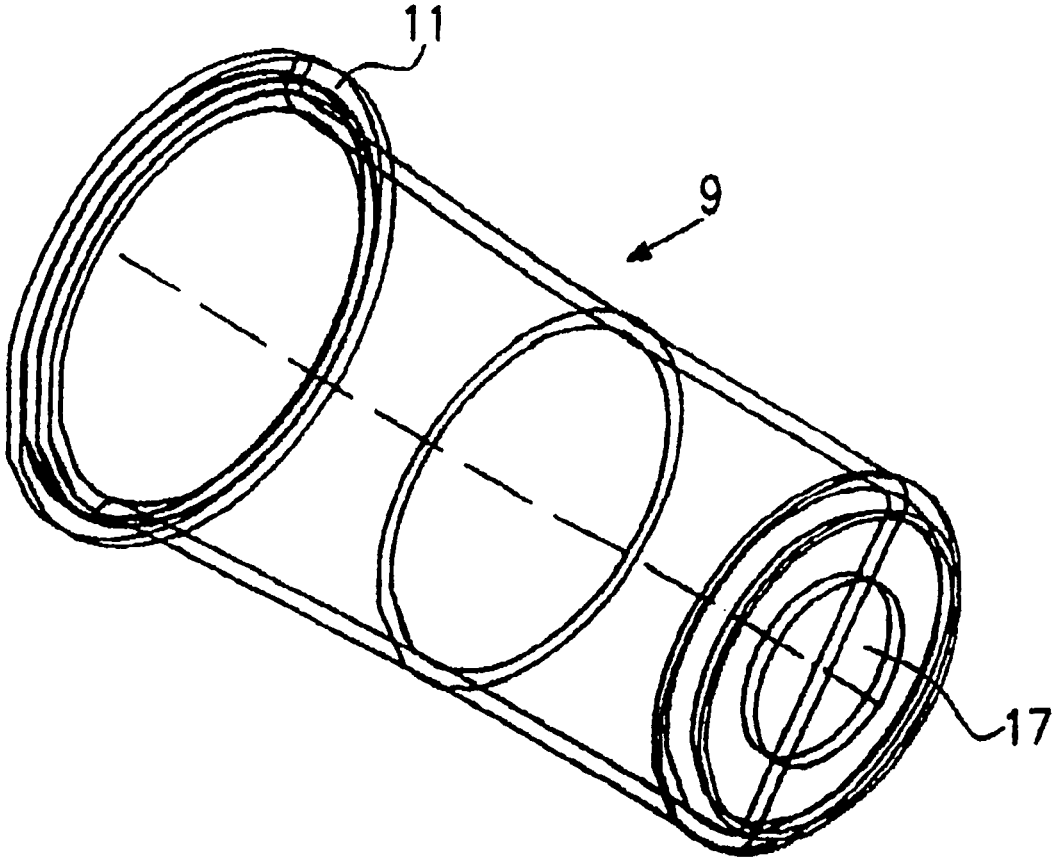
FIG. 7 is a simplified perspective view of an embodiment of the support according to the present invention.

A hat-shaped or cup-shaped support 9 is fitted into each of the assembly openings 8 which—as also becomes apparent from FIG. 7—is provided with a centric opening 17 to allow the bolt 15 to be passed through.

FIG. 4 also shows that a rim 10 of the cover 7 is profiled or bent to ensure a close, firm seat in the annulus 5. A rim area 11 of the support 9 is similarly bent or profiled to retain and pre-load the cover. For this purpose, the length of the support 9 is slightly shorter than the available depth in the annulus 5, so that the cover 7 is appropriately clamped by tightening the bolt 15.

Figure 5:
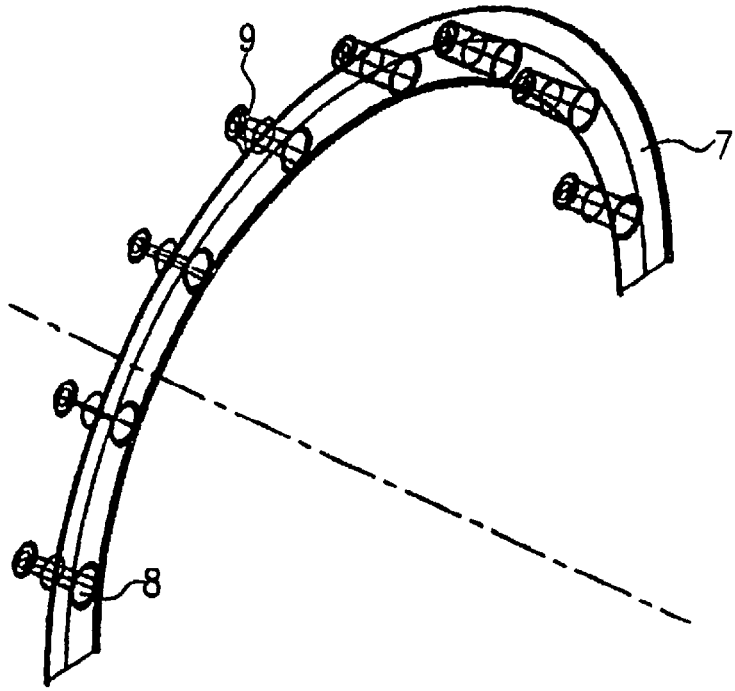
FIG. 5 is a simplified perspective partial view of a cover with supports according to the present invention.
Figure 6:
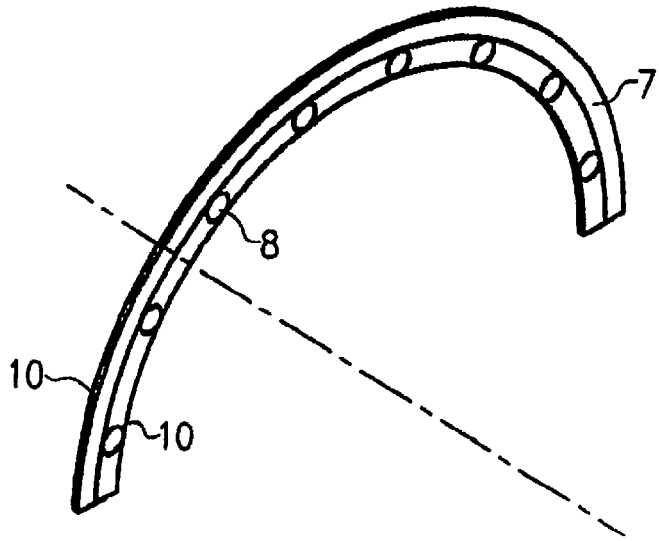
FIG. 6 is a perspective view analogically to FIG. 5 of the cover according to the present invention.

FIG. 6 shows in perspective partial view the annular cover 7, while FIG. 5 is a schematic view both of the individual supports 9 and the cover 7.

It is obvious that a corresponding cover 7 with mating supports 9 can be fitted to the forward shroud segment 3 also in the left-hand representation of FIG. 4. A respective drawing representation is, however, dispensed with for reasons of simplification.

It is apparent that a plurality of features other than described herein may be incorporated in the present embodiment without departing from the inventive concept. It is also contemplated that various aspects of the present invention can be combined in different manners to create new embodiments.

What is claimed is:

1. A cover for a shroud segment for the support of vane roots of variable stator vanes in a high-pressure compressor of a gas turbine; comprising:

an annular body constructed and arranged to be positioned in an axially open annulus of the shroud segment, the annular body including a plurality of assembly openings that are positioned to align with a plurality of assembly holes in the shroud segment; and a plurality of tubular supports positioned to align with the plurality of assembly openings respectively and to extend from the annular body toward the assembly holes in the shroud segment.

2. A cover in accordance with claim 1, wherein the cover body is constructed of sheet metal.

3. A cover in accordance with claim 1, wherein the cover body is designed essentially in the form of a flat ring.

4. A cover in accordance with claim 3, wherein the cover body is profiled at rims thereof.

5. A cover in accordance with claim 4, wherein the supports are one of cup-shaped and hat-shaped.

6. A cover in accordance with claim 5, wherein free rim areas of the supports are profiled to engage the annular body when the supports are positioned in the assembly openings for the retention of the cover.

7. A cover in accordance with claim 6, wherein the cover body and the supports are individual parts.

8. A cover in accordance with claim 5, wherein the cover body and the supports are a single part.

9. A cover in accordance with claim 5, wherein a height of the supports is smaller than a depth of the annulus such that when assembly fasteners positioned in the supports and the shroud segment are tightened, the cover will be drawn into the annulus to preload the cover in the shroud segment.

10. A cover in accordance with claim 5 and further comprising the shroud segment.

11. A cover in accordance with claim 6, wherein a height of the supports is smaller than a depth of the annulus such that when assembly fasteners positioned in the supports and the shroud segment are tightened, the cover will be drawn into the annulus to preload the cover in the shroud segment.

12. A cover in accordance with claim 1 and further comprising the shroud segment.

13. A cover in accordance with claim 1, wherein the cover body and the supports are constructed of metal.

14. A cover in accordance with claim 1, wherein the cover body and the supports are constructed of plastic.

15. A cover in accordance with claim 1, wherein the cover body is profiled at rims thereof.

16. A cover in accordance with claim 1, wherein the supports are one of cup-shaped and hat-shaped.

17. A cover in accordance with claim 1, wherein free rim areas of the supports are profiled to engage the annular body when the supports are positioned in the assembly openings for the retention of the cover.

18. A cover in accordance with claim 1, wherein the cover body and the supports are individual parts.

19. A cover in accordance with claim 1, wherein the cover body and the supports are a single part.

20. A cover in accordance with claim 1, wherein a height of the supports is smaller than a depth of the annulus such that when assembly fasteners positioned in the supports and the shroud segment are tightened, the cover will be drawn into the annulus to preload the cover in the shroud segment.

* * * * *